US008114811B2

(12) United States Patent
Denton et al.

(10) Patent No.: US 8,114,811 B2
(45) Date of Patent: Feb. 14, 2012

(54) PRINTABLE ADHESIVE LABEL

(75) Inventors: Jeffery S. Denton, Springboro, OH (US); Mark E. Keeton, Kettering, OH (US)

(73) Assignee: NCR Corporation, Duluth, GA (US)

( * ) Notice: Subject to any disclaimer, the term of this patent is extended or adjusted under 35 U.S.C. 154(b) by 625 days.

(21) Appl. No.: 12/270,488

(22) Filed: Nov. 13, 2008

(65) Prior Publication Data

US 2010/0120613 A1 May 13, 2010

(51) Int. Cl.
*B41M 5/30* (2006.01)

(52) U.S. Cl. ..... 503/201; 427/152; 503/226

(58) Field of Classification Search ..... None
See application file for complete search history.

(56) References Cited

U.S. PATENT DOCUMENTS 4,898,849 A * 2/1990 Kang ..... 503/214

* cited by examiner

*Primary Examiner* — Bruce H Hess
(74) *Attorney, Agent, or Firm* — Paul W. Martin; Dana T. Hustins

(57) ABSTRACT

A label, method of printing and method of manufacture that includes a label comprising a transparent protective layer, a thermosensitive image-forming adhesive layer and a release liner. The transparent protective layer is of a thickness and weight, which permits sufficient heat to be conducted through it to the thermosensitive image-forming adhesive layer to cause thermally active dye in the thermosensitive image-forming adhesive layer to change color in the area where the heat is conducted.

19 Claims, 2 Drawing Sheets

PRINTABLE ADHESIVE LABEL

TECHNICAL FIELD

A label, method of printing and method of manufacture described herein relates generally to improvements to printable labels. More particularly, the invention relates to improvement to labels used in harsh environments.

BACKGROUND

A label used in a hazardous environment can come into contact with harsh chemicals, abrasive materials and other elements that will degrade the readability of the label. Labels uses in such hazardous conditions typically have a protective layer applied to the exterior surface of the label to protect the label from the hazardous environment. Currently, labels used in hazardous environments are printed using standard printing processes (i.e., thermal, ink jet or laser) and then in a separate step, they are laminated with a transparent layer to protect the labels from hazardous conditions. The lamination step, while effective, is time consuming and adds expense to the label.

BRIEF DESCRIPTION OF THE DRAWINGS

The invention, in accordance with preferred and exemplary embodiments, together with further objects and advantages thereof, is more particularly described in the following description taken in conjunction with the accompanying drawings in which like reference characters designate the same or similar parts throughout the several views and wherein.

DETAILED DESCRIPTION

In the following description, numerous details are set forth to provide an understanding of the claimed invention. However, it will be understood by those skilled in the art that the claimed invention may be practiced without these details and that numerous variations or modifications from the described embodiments are possible.

Figure 1:
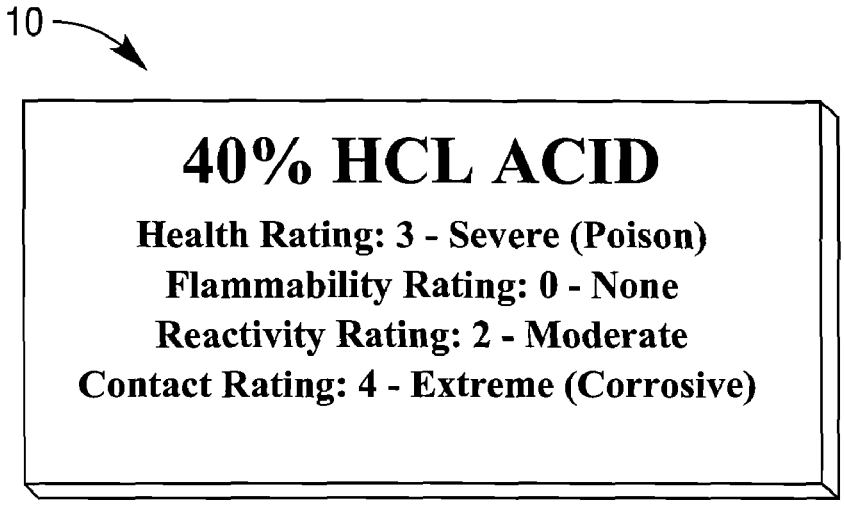
FIG. 1 is a front view of a printable multilayer sheet in accordance with an exemplary embodiment of a label used in a hazardous environment.

Illustrated in FIG. 1 is a front view of label 10. Label 10 is made from a portion of a printable multilayer sheet designed for use in hazardous environments. Information, including text and/or graphics, can be printed on the label 10 and the information is visible through the front surface of the label 10. In addition, the label 10 can be applied to numerous surfaces using a pressure sensitive adhesive that is part of the label 10. In this embodiment, basic Material Safety Data Sheet (MSDS) information for a hazardous chemical is printed on label 10. The information printed on label 10 relates to hydrochloric acid (HCL) and the label 10 can be attached to any surface (i.e., the surface of a container of HCL or a storage area where a container of HCL is stored).

Figure 2:
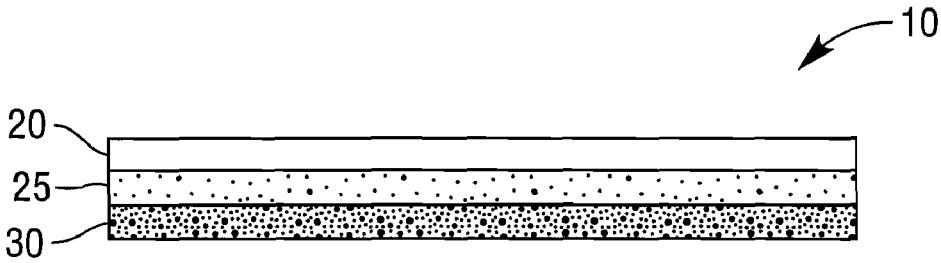
FIG. 2 is a cross-sectional view of a portion of the printable multilayer sheet of FIG. 1.

FIG. 2 illustrates a cross-section of a portion of label 10. The top layer is a transparent protective laminate 20 that is able to withstand harsh chemical and abrasive environments. In some embodiments, the protective laminate also blocks ultra-violet light which can degrade the readability of the information printed on the label 10. Illustrative examples of suitable materials for the protective laminate include polyester, polypropylene and cellulose acetate films. However, any clear or nearly clear material that protects the underling label is a candidate for use as a protective laminate 20. This embodiment utilizes thermal printing techniques therefore good heat transfer through protective laminate 20 is required. This is achieved by using a protective laminate 20 that is not only clear but also thin with acceptable thermal conductive. A polyester protective laminate 20 having a thickness in the range of 1 to 2 mils is suitable. However, in other embodiments, using a protective laminate 20 with different thermal characteristics or changing the thermal characteristics of the printing device or the printing speed allows different thicknesses of protective laminates 20 to be used. In some cases, a thicker protective laminate 20 is required to properly protect the label from a harsh environment so other parameters must be adjusted to compensate for the thicker protective laminate 20.

Continuing with FIG. 2, a thermosensitive image-forming adhesive layer 25 is permanently bonded or laminated to the bottom surface of the protective laminate 20. The thermosensitive image-forming adhesive layer 25 is a composition of a pressure sensitive adhesive compound and a thermosensitive image compound. The pressure sensitive adhesive provides the adhesive force to attach the label 10 to a surface after pressure is applied to the top surface of the label 10. The thermosensitive image compound changes color when exposed to heat and thus creates a readable label 10. A standard thermosensitive image compound is comprised of thermally active dyes, reactants and fillers. However, when combined with the pressure sensitive adhesive, the adhesive replaces all or part of the fillers used in the standard thermosensitive compound. An illustrative example of a formula for the composition of the thermosensitive image-forming adhesive layer 25 is 15 parts dye, 20 parts reactant and 65 parts adhesive compound. However, it should be noted that this formula will change based on the characteristics of the components uses in the compounds.

FIG. 2 also shows a release layer 30 that is positioned over the thermosensitive image-forming adhesive layer 25. It is releasably bonded to the thermosensitive image-forming adhesive layer 25. The release layer 30 may have a release agent, such as silicone, coated there between to permit removal from the label 10 by being peeled the release layer 30 away from the thermosensitive image-forming adhesive layer 25.

Figure 3:
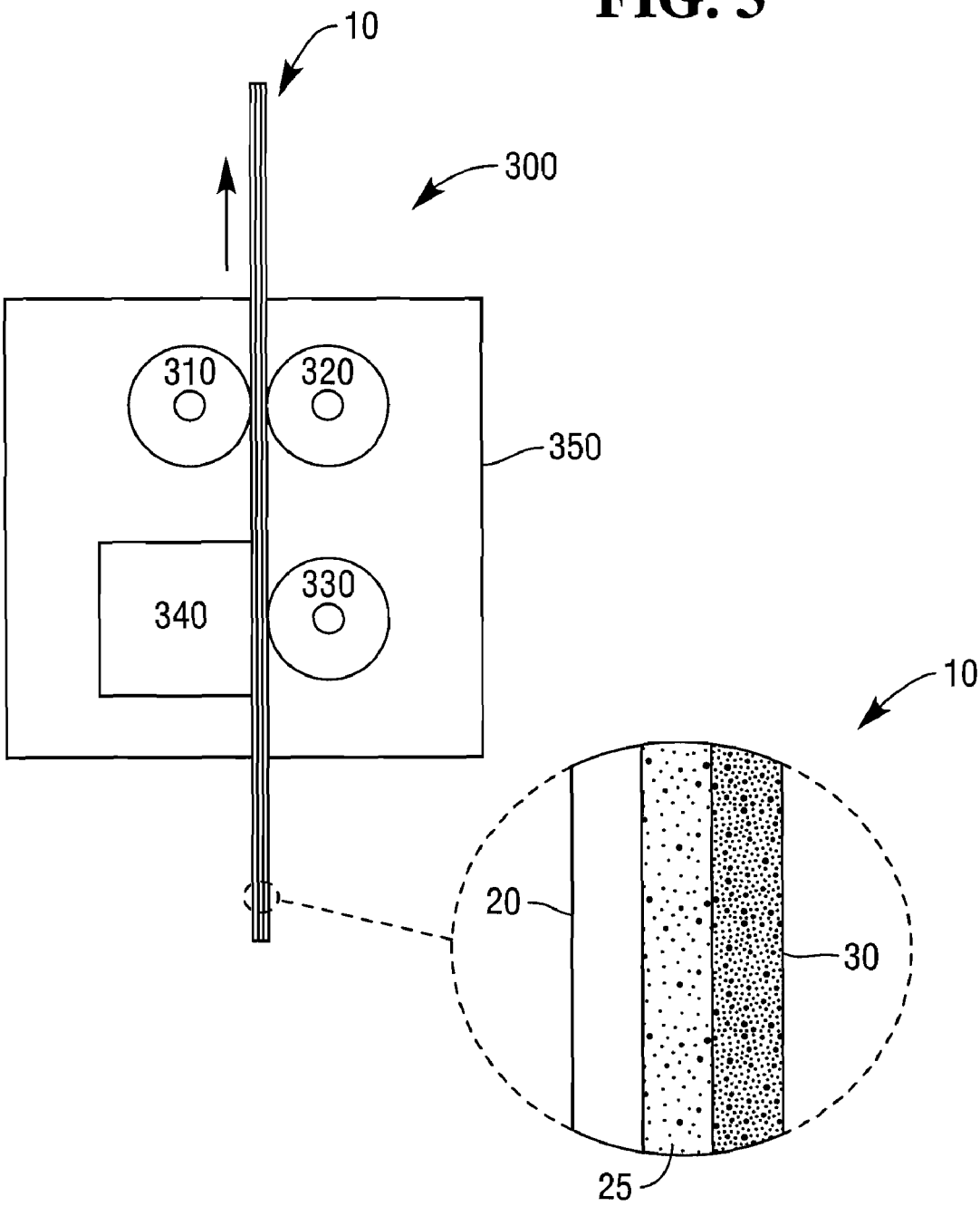
FIG. 3 is a high-level block diagram of a thermal printer printing on a printable multilayer sheet.

Referring now to FIG. 3, there is presented a high-level block diagram of a thermal printer 300 comprising a print head assembly 350 and a printable multilayer sheet 10. The thermal print head assembly 350 is comprised of two opposed feed rollers 310, 320 that pull the printable multilayer sheet 10 through the thermal print head assembly 350. The assembly 350 also is comprised of a thermal print head 340 and an opposing platen 330 where the printable multilayer sheet 10 is pulled between the two by the feed rollers 310, 320. The printable multilayer sheet 10 is feed through the thermal print head assembly 350 configured so that the transparent protective layer 20 is pressed against the print head 340.

To print a pattern containing text, graphic or an image on the printable multilayer sheet 10, a section of the printable multilayer sheet 10 is feed through the thermal print head assembly 350. Based on the desired pattern, the print head 340 selectively generates heat in selected areas on the surface of the transparent protective layer 20. The heat is conducted through the transparent protective layer 20 to the thermosensitive image-forming adhesive layer 25 causing thermally active dye in the heated area of the thermosensitive image-forming adhesive layer 25 to change color. This process is repeated until the desired pattern is imaged on the surface of the thermosensitive image-forming adhesive layer 25. Since the transparent protective layer 20 is transparent, it permits the pattern to be viewed while protecting the thermosensitive image-forming adhesive layer 25 from adverse conditions that would negatively impact the readability of the pattern. The printable multilayer sheet 10 can be cut or separated into smaller labels, each containing a pattern. Printable multilayer sheets 10 can be manufactured in different sizes and length depending on the type printer being used or the desired label.

Once a label 10 has been printed, it can be attached to a desired surface by peeling the release liner 30 off the bottom surface of the thermosensitive image-forming adhesive layer 25, placing the bottom surface of the thermosensitive image-forming adhesive layer 25 against the desired surface and applying temporary pressure to the front surface 20 of the label 10.

The present embodiment uses thermal printing techniques to illustrate the invention however, other embodiments are based on different printing techniques such as light diode technology. Light diode technology uses light to activate a component, similar to a thermal dye. A light receptive dye is placed in the adhesive layer in place of the thermal dye. Light from a diode passing through the clear protective layer activates the light receptive dye causing it to change color similar to heat causing the thermal dye to change color.

In another embodiment, the release layer 30 and thermosensitive image-forming adhesive layer 25 are sufficiently thin for a printer to print through the release layer 30 to the thermosensitive image-forming adhesive layer 25 causing the thermally active dyes to change color and be visible through the transparent protective layer 20. The thermosensitive image-forming adhesive layer 25 must be sufficiently thin so that the heat causes the thermally active dyes to completely change color through the entire thickness of the thermosensitive image-forming adhesive layer 25. Otherwise, the pattern will not visible from the front side of the label 10. In this embodiment, a mirror image of the pattern to be viewed is printed through the release layer 30 (backside of the label 10) and the pattern is properly viewed through the transparent protective layer 20 (front side of the label 10).

While the invention is disclosed in the context of thermal printing on a printable multilayer sheet or label, it will be recognized that a wide variety of implementations may be employed by a person of ordinary skill in the art consistent with the above discussion and the claims, which follow below.

What is claimed is:

1. A printable multilayer label comprising:

a transparent protective layer having a top surface and a bottom surface;

a thermosensitive image-forming adhesive layer bonded to the bottom surface of the transparent protective layer wherein the thermosensitive image-forming adhesive layer comprises a thermally active dye that changes color when heated; and wherein the transparent protective layer is of a thickness and weight, which permits sufficient heat to be conducted through it to an area of the thermosensitive image-forming adhesive layer to cause the thermally active dye to change color in the area where the heat is conducted.

2. The label of claim 1, wherein the thermosensitive image-forming adhesive layer comprises a pressure sensitive adhesive operable to attach the label to a surface.

3. The label of claim 1, further comprising a release liner layer releasably bonded to the thermosensitive image-forming adhesive layer.

4. The label of claim 1, wherein the transparent protective layer is comprised of polyester.

5. The label of claim 1, wherein the transparent protective layer is comprised of polypropylene.

6. The label of claim 1, wherein the transparent protective layer is comprised of cellulose acetate.

7. A method of printing a label comprising:

applying heat to a portion of a protective layer of the label; and conducting sufficient heat through the protective layer to an image-forming adhesive layer of the label so that a portion of the image-forming adhesive layer is raised to a temperature where thermally active dye in the portion of the image-forming adhesive layer changes color.

8. The method of claim 7, wherein the image-forming adhesive layer is laminated to the protective layer.

9. The method of claim 8, wherein the protective layer is transparent allowing the color change of the thermally active dye in the image-forming adhesive layer to be visible through the protective layer.

10. The method of claim 7, where the image-forming adhesive layer comprises a pressure sensitive adhesive.

11. The method of claim 10, wherein the label further comprises a release liner that is releasably bonded to the image-forming adhesive layer.

12. The method of claim 11, wherein the protective layer is transparent, thus allowing the color change of the thermally active dye in the image-forming adhesive layer to be visible through the protective layer.

13. The method of claim 11, further comprising attaching the label to a surface by peeling off the release liner and placing the exposed image-forming adhesive layer against the surface and applying temporary pressure to the label.

14. A method of manufacture for a printable multilayer sheet, the method comprising:

bonding a transparent layer to a thermosensitive image-forming adhesive layer where the thermosensitive image-forming adhesive layer comprises thermally active dye that change color when heat is applied and where the transparent layer is of a thickness and weight, which permits sufficient heat to be conducted through it to an area of the thermosensitive image-forming adhesive layer to cause the thermally active dye to change color in the area where the heat is conducted.

15. The method of claim 14, further comprising releasably bonding a release liner layer to the thermosensitive image-forming adhesive layer.

16. The method of claim 14, wherein the transparent layer is comprised of polyester.

17. The method of claim 14, wherein the transparent layer is comprised of polypropylene.

18. The method of claim 14, wherein the transparent layer is comprised of cellulose acetate.

19. The method of claim 14, wherein the thermosensitive image-forming adhesive layer is further comprised of a pressure sensitive adhesive.

* * * * *